United States Patent [19]

Vilagi et al.

[11] 4,360,132

[45] Nov. 23, 1982

[54] SAFETY CONTROL FOR AUTOMATIC DISPENSING GUN

[75] Inventors: Burton J. Vilagi; Donald R. Scharf, both of Amherst; Lawrence J. Macartney, Lorain, all of Ohio

[73] Assignee: Nordson Corporation, Amherst, Ohio

[21] Appl. No.: 149,967

[22] Filed: May 15, 1980

[51] Int. Cl.[3] ..... B05B 15/06

[52] U.S. Cl. ..... 222/504; 239/288; 239/412; 239/DIG. 22

[58] Field of Search ..... 222/504; 239/288, 288.3, 239/288.5, 412, DIG. 22; 118/685

[56] References Cited

U.S. PATENT DOCUMENTS

Re. 27,865 1/1974 Baker et al. ..... 222/504

4,181,261 1/1980 Crum ..... 239/288.5

FOREIGN PATENT DOCUMENTS 362629 7/1962 Switzerland ..... 239/412

*Primary Examiner*—Joseph J. Rolla

*Assistant Examiner*—Frederick R. Handren

*Attorney, Agent, or Firm*—Wood, Herron & Evans

[57] ABSTRACT

An automatic safety system is built into a pneumatic motor actuated dispensing gun to prevent the gun from dispensing liquid material whenever the nozzle of the gun is loosened or removed from the gun body. The safety system comprises an air flow passage contained internally of the gun body for connecting the pneumatic motor to a normally sealed surface located between the nozzle and the gun body. Removal or loosening of the nozzle relative to the body, breaks this sealed surface and results in leakage of sufficient air pressure to atmosphere as to prevent actuation of the pneumatic motor and thus opening of the normally closed flow control valve of the gun.

2 Claims, 1 Drawing Figure

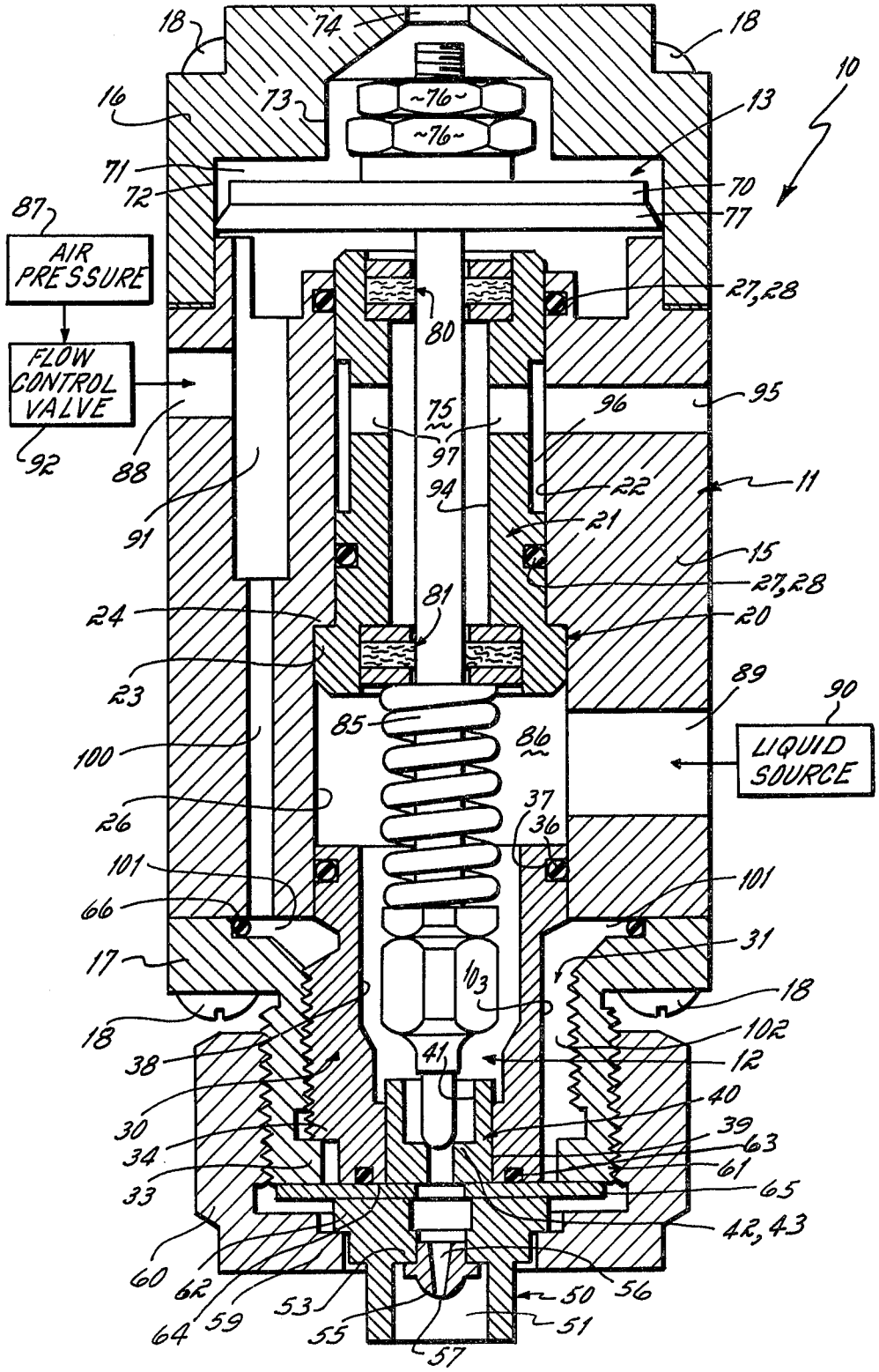
AIR PRESSURE
FLOW CONTROL VALVE
LIQUID SOURCE

SAFETY CONTROL FOR AUTOMATIC DISPENSING GUN

This invention relates to dispensing devices, and more particularly, to a safety device for use in connection with such devices.

A characteristic of many dispensing devices, or so-called dispensing guns, is that they emit a relatively high pressure stream of liquid which can be sprayed or injected into and through the skin of a human operator or repairman in the event that that operator or repairman gets too close to the gun orifice or nozzle. Depending upon the substance being sprayed from the gun, the timeliness of treatment, etc. this injection may create a serious health hazard from poisoning or infection.

In general, there is a potential for injection of liquid dispensed from a dispensing gun only if the operator is very close to the nozzle orifice, or if the nozzle is removed such that there is no nozzle orifice present to break up the liquid stream emitted from the gun into small droplets which quickly lose their velocity. Recently, there has been a trend toward providing manually operated dispensing guns with a nozzle guard which fits over the nozzle or dispensing orifice so as to prevent the human operator from placing his hand or any part of his body in sufficiently close proximity to the nozzle or orifice as to create a potential for liquid injection of material emanating from the nozzle.

In at least one case, that disclosed in U.S. Pat. No. 4,181,261, it has been proposed to provide a nozzle guard with a safety system which automatically renders the gun inoperative in the event that the guard becomes broken or is removed by the operator. That safety system comprises a pneumatic flow path operable to control a pneumatically actuated valve contained in the liquid flow stream to the gun. In the event of loss of air pressure to that valve, such as would occur in the event that the nozzle guard is broken or removed, the normally closed pneumatic valve remains closed and shuts off the flow of liquid to the gun. Consequently, actuation of the gun trigger by the operator results in a no-flow condition to the nozzle orifice for so long as the guard remains broken or removed from the gun.

While the problem of accidental liquid injection of human operators of dispensing devices has predominantly been a problem with manually actuated guns, there has also been a similar problem in the case of automatic guns, i.e., those which contain a motor internally of the gun for controlling opening and closing of a gun flow control valve and a remote switch or valve for controlling actuation of the motor. Those guns commonly are not provided with nozzle guards because the frequency of a human operator being proximate the nozzle orifice does not justify the provision of the guard, or because the nozzle orifice is located so close to the workpiece or substrate upon which the spray is directed as to preclude the use of a nozzle guard. But there is a need for a safety device or system in such automatic dispensing guns whenever the human operator removes the nozzle, as for example to clear it of foreign material in the nozzle orifice. While the operator is removing or manipulating the nozzle, his hand is sufficiently close to the nozzle orifice as to create the potential for an accidental injection of material sprayed from the nozzle. This type of accident most commonly occurs because the remote control switch or valve of the gun is inadvertently or accidentally actuated while the operator's hand is proximate the nozzle orifice. Consequently, there is a need for such a safety system in an automatic gun of the type which commonly does not utilize a nozzle guard.

It has therefore been a primary objective of this invention to provide a safety device for use in an automatic dispensing gun which will preclude operation of the gun in the event that the gun nozzle is loosened or removed from the gun.

In a conventional automatic (as opposed to a manual) dispensing device or dispensing gun, flow of liquid through the gun is controlled by opening and closing of a valve located immediately adjacent the nozzle orifice of the gun. Opening and closing of this valve is controlled by a pneumatic motor contained within the gun body. There is an air flow passage through the gun body to the pneumatic motor, and according to the practice of this invention this pneumatic flow passage is connected via another passage to a sealed surface located between the gun body and the gun nozzle. In the event that the nozzle is loosened relative to the gun body this sealed surface is broken with the result that air leaks through this now unsealed surface to the atmosphere. Air leakage results in insufficient pressure to the pneumatic motor of the gun to cause the motor to actuate and the gun flow control valve to open. Thus, so long as the nozzle is loose relative to the body or removed from the body, there is insufficient air pressure available to cause the flow control valve of the gun to be opened, and thereby permit the flow of high pressure liquid from the gun.

The primary advantage of this invention is that it provides a fail-safe system for an automatic type of dispensing device which prevents operation of the gun whenever the nozzle is removed from the gun body or whenever the nozzle is loose relative to the gun body. Thus, it is impossible for an operator to be accidentally injected with liquid material emanating from the gun whenever the nozzle is removed or loose relative to the gun body.

These and other objects and advantages of this invention will be more readily apparent from the following description of the drawing which is a cross-sectional view through a dispensing gun incorporating the invention of this application.

The dispensing gun 10 of this invention comprises a three-piece gun housing 11 within which there is located a valve assembly 12 for controlling flow of liquid material from the gun and a pneumatic motor 13 for controlling actuation of the valve 12. The three-piece gun housing comprises a gun body 15, an end cap 16, and a body cap 17. The end cap 16 and body cap 17 are secured to opposite ends of the body 15 by machine screws 18 extending through bores (not shown) in the caps and threaded into threaded bores (not shown) of the gun body 15.

The gun body 15 contains a stepped axial bore 20. A bushing 21 is mounted within the smaller diameter rear section 22 of this bore 20. This bushing 21 has a flange 23 at its forward end which abuts a shoulder 24 located between the two different diameter sections of the bore 20. O-ring seals 27 are contained within annular recesses 28 in the periphery of the bushing 21 so as to maintain a seal between the peripheral surface of the bushing 21 and the bore 20.

There is also an axial bore 31 extending through the body cap 17. A valve seat holder 30 is mounted within this axial bore 31. This valve seat holder 30 is retained within the bore 31 of the body cap by engagement of an inwardly extending flange 33 at the forward end of the cap 17 with a shoulder 34 located on the front end of the valve seat holder 30. At the top, the valve seat holder 30 extends into the large diameter section 26 of the bore 20 in the gun body and is sealed relative thereto by an O-ring seal 36 located within an annular recess 37 in the periphery of the valve seat holder 30.

The valve seat holder 30 is generally tubular in configuration and has an axial bore 38 extending therethrough. At its forward end, this bore 38 terminates in a small diameter section 39 within which there is located a valve seat 40. This seat 40 is fixedly secured within the forward end of the valve seat holder 30 by being brazed therein.

A stepped bore 41 extends axially through the valve seat 40. The innermost edge of a shoulder 42 located between the two different diameter sections of the valve seat 41 defines a seat 43 of the valve 12.

Removably mounted on the forward end of the gun body 15 is a nozzle holder 50. There is a stepped bore 51 extending axially through the holder. The larger diameter section of this bore is located at the outer end of the holder. At the intersection between the two different diameter sections of the bore 51 there is a shoulder 53 upon which is seated the nozzle 55 of the gun. This nozzle has an axial bore 56 extending therethrough, the outer end of which terminates in an orifice 57 through which liquid is emitted from the gun.

The nozzle holder 50 is removably retained on the outer end of the body 15 by a retainer nut 60 threaded onto the threaded outer end section 61 of the body cap 17. This nut 60 has an inwardly extending flange 59 engageable with a peripheral flange 62 of the nozzle holder 50 to retain the nozzle holder on the outer end of the body.

In accordance with the practice of the invention of this application, there is a metal washer seal 65 sandwiched between the outer end of the body cap 17 and the nozzle holder 50. An O-ring seal 63 mounted within an annular groove in the front face 64 of the valve seat holder 30 cooperates with the washer seal 65 to seal the surface between the nozzle holder 50 and the gun body 15 whenever the nozzle holder is tightly secured to the gun body by the retainer nut 60. The O-ring seal 63 also prevents the escape of liquid by flow between the outer face of the valve seat holder 30 and the inner surface of the washer 65.

Located internally of the gun body is the pneumatically actuated motor 13 for controlling opening and closing of the valve assembly 12 relative to the valve seat 43. This motor comprises a piston 70 slideably mounted within a cylinder 71 defined by a stepped bore 72 formed in the interior of the end cap 16. This cylinder bore 72 is open to atmosphere via a smaller diameter section 73 and a vent port 74.

The piston 70 is fixedly secured to a valve stem 75 by a pair of lock nuts 76. Secured to the underside of the piston 70 there is a lip seal 77 which contacts the bore 72 at its periphery so as to form a pneumatic seal about the underside of the piston.

The valve stem 75 extends between the piston 70 and the valve 12, and in so doing fixedly interconnects the two such that movement of the piston effects corresponding movement of the valve 12. Between the piston and the valve 12, the valve stem 75 passes through a pair of spaced packing seals 80, 81. These packing seals 80, 81 are mounted in the opposite ends of the bushing 21 so as to form a seal between the interior surface of the bushing and the exterior surface of the valve stem.

Located between the valve 12 and the lower packing seal 81, there is a compression spring 85. This spring is engageable at one end with the valve 12 and at the opposite end with the packing seal 81 so that it biases the valve 12 downwardly into a closed condition.

Surrounding the compression spring 85, there is a liquid storage chamber 86 which communicates with the valve seat 43 via the axial bore 38 in the valve seat holder 30. This liquid storage chamber 86 is connected to a pressurized source of liquid 90 via port 89 such that whenever the valve 12 is open, liquid flows from the source 90 through the chamber 86 and bore 38 and downwardly through the valve seat 41 to and through the nozzle orifice 57.

In order to connect the underside of the pneumatic motor 13 to a source of air pressure sufficient to actuate the pneumatic motor 13 against the bias of the spring 85, there is a pneumatic port 88 which extends through the gun body 15 and communicates with a flow passage 91. This passage 91 opens into the cylinder 70 on the underside of the piston 70 such that air pressure supplies to the port 88 from an air pressure source 87 causes the piston 70 to move upwardly against the bias of the spring 85 and thereby open the valve 12.

Preferably, vent ports 95 through the gun body 15 connect an annular groove 96 formed in the periphery of the bushing 21 to atmosphere. This groove 96 is also open to the interior bore 94 of the bushing 21 via ports 97 which extend through the side walls of the bushing. The purpose of these vents 95, 97 is to connect the bore 20 in the gun body and the bore 94 in the bushing to atmosphere so that any liquid which inadvertently seeps from the liquid chamber 86 upwardly around the seals 81 and 27 does not reach the pneumatic motor 13. Instead, that seepage liquid is vented to atmosphere through the vent ports 97, 95.

In operation of the dispensing gun 10, liquid under pressure from a liquid supply source 90 is maintained in fluid communication with the storage chamber 86 of the gun. Consequently, liquid stored under pressure in the chamber 86 is available to flow from the gun 10 through the nozzle orifice 57 in the event that the valve 12 is opened. When the valve 12 is to be opened, air under pressure from the source 87 is supplied to the port 88 of the gun, preferably through a flow control valve 92. This flow control valve 92 may be opened and closed by any conventional actuator, as for example an electrical switch actuated solenoid or a pneumatic motor controlled by a pneumatic switch. Whenever air under pressure is supplied to the port 88, it causes the piston 70 to move upwardly, thereby moving the valve 12 upwardly and off of the valve seat 43. This results in liquid flow from the chamber 86 through bore 38 to the valve seat 43 and subsequently to the nozzle orifice 57.

The dispensing gun 10 heretofore described except for the provision of the washer seal 65, is a conventional dispensing gun which operates in a conventional manner and per se forms no part of the invention of this application.

The invention of this application resides in a safety feature which precludes the nozzle holder 50 and nozzle 55 from being loosened or removed from the gun body without disabling the gun. In other words, according to the practice of this invention loosening of the retainer nut 60 for purposes of removing the nozzle holder 50 will automatically disable the gun and prevent the valve 12 from opening. To that end, according to the practice of this invention, the pneumatic port 88 is connected via three parallel passages 100 (only one of which is illustrated) which extend longitudinally from the underside of the cylinder 72 to an annular channel 101 formed in the top surface of the body cap 17. This annular channel 101 in the body cap 17 in turn communicates via longitudinal passages 102 with the top surface of the washer seal 65. The passages 102 are formed by flats 103 located on the periphery of the valve seat holder 30.

So long as the washer seal 65 remains sealed between the gun body and the gun nozzle holder, there is no air flow through the passages 100, 102 which interconnect the pneumatic port 88 with the sealed surface. However, if the retainer nut 60 is loosened, as for example occurs whenever the nozzle and nozzle holder are to be removed for cleaning or replacement, the seal is broken so that air supplied to the gun pneumatic port 88 is vented through the passages 100, 102 and the washer seal to atmosphere via the nozzle orifice 57. This venting of the pressure prevents the pressure to the underside of the piston 70 from generating a force sufficient to overcome the force of the compression spring 85 and open the valve 12. Consequently, the valve 12 remains in contact with the valve seat 43 and closed so long as the nozzle holder is loose relative to the gun body or so long as the nozzle holder is removed from the gun body.

The primary advantage of the safety feature of this invention is that it is fail-safe in that the valve 12 of the gun can never be opened whenever the nozzle or nozzle holder is removed or even loosened relative to the gun body. Consequently, an operator cannot be injured by accidental injection of liquid emitted from the gun when the nozzle is removed or the nozzle is in the process of being loosened and removed from the gun.

While we have described only a single preferred embodiment of our invention, persons skilled in this art will appreciate changes and modifications which may be made without departing from the spirit of our invention. Therefore, we do not intend to be limited except by the scope of the following appended claims.

Having described our invention, we claim:

1. A fluid pressure actuated despensing gun for applying liquid to a substrate, which gun comprises, a gun body, nozzle means comprising a nozzle holder and a nozzle tip fixedly mounted within said nozzle holder, a washer sealingly secured between said nozzle holder and a forward end surface of said gun body, said nozzle holder being removably mounted upon said gun body by a retainer nut engageable with the nozzle holder, means defining a liquid storage chamber in said gun body, valve means operable to control liquid flow from said storage chamber to said nozzle means, means defining a fluid cylinder in said gun body, said fluid cylinder being coaxially aligned with said nozzle means and said valve means, a reciprocable piston mounted in said cylinder, said valve means including a movable valve stem, said valve stem being operatively connected to said piston and extending through said liquid storage chamber to said valve means, such that movement of said piston controls opening and closing of said valve means, a spring for biasing said valve means to a closed position, said gun body having a first passage means therein for communicating between a source of liquid and said liquid storage chamber, said gun body having a second passage means therein communicating between a source of fluid pressure and said fluid cylinder, safety means for preventing said valve means from opening whenever said nozzle means is loosened relative to said gun body, said safety means comprising a third passage means in said gun body connecting said second passage to an opening in said end surface, said washer normally disposed over and sealing said opening from atmosphere such that loosening of said nozzle means on said gun body unseals said opening and leaks fluid pressure from said second passage to atmosphere, thereby precluding fluid pressure on said piston from building to a pressure sufficient to overcome the bias of said spring and effect opening of said valve means.

2. A fluid pressure actuated dispensing gun for applying liquid to a substrate, which gun comprises, a gun body, nozzle means comprising a nozzle holder and a nozzle tip fixedly mounted within said nozzle holder, a washer sealingly secured between a forward end surface of said gun body and said nozzle holder, said nozzle holder being removably mounted upon said gun body by a retainer nut engageable with the nozzle holder, means defining a liquid storage chamber in said gun body, a gun flow control valve including a valve seat located within said chamber, means defining a fluid cylinder in said gun body, said fluid cylinder being in axial alignment with said valve seat and said nozzle means, a reciprocable piston mounted in said cylinder, said gun flow control valve including a movable valve element, said valve element being operatively connected to said piston at one end and being engageable with said valve seat at the opposite end to close said liquid storage chamber, a spring for biasing said valve element to a closed position relative to said valve seat, said gun body having a first passage means therein for communicating between a source of liquid and said liquid storage chamber, said gun body having a second passage means therein communicating between a source of fluid pressure and said fluid cylinder, and safety means for preventing said valve element from moving off of said valve seat whenever said nozzle means is loosened relative to said gun body, said safety means comprising a third passage means in said gun body connecting said second passage to an opening in said end surface, said washer normally disposed over and sealing said opening from atmosphere such that loosening of said nozzle means unseals said opening and leaks fluid pressure from said second passage to atmosphere so as to preclude fluid pressure on said piston from building to a pressure sufficient to overcome the bias of said spring and effect movement of said valve element off of said valve seat.

* * * * *